US006032733A

United States Patent [19]

Ludwig et al.

[11] Patent Number: 6,032,733

[45] Date of Patent: Mar. 7, 2000

[54] CABLE HEAD

[75] Inventors: Wesley Neil Ludwig, Houston; Charles W. Weinstock, The Woodlands, both of Tex.

[73] Assignees: Halliburton Energy Services, Inc.; Chevron Corporation, Houston, Tex.

[21] Appl. No.: 08/918,530

[22] Filed: Aug. 22, 1997

[51] Int. Cl.[7] ..... E21B 23/04

[52] U.S. Cl. ..... 166/60; 166/65.1; 166/385

[58] Field of Search ..... 166/60, 65.1, 301, 166/377, 378, 385, 381

[56] References Cited

U.S. PATENT DOCUMENTS

| | | | |
|---|---|---|---|
| 3,677,081 | 7/1972 | Newton et al. | 166/100 X |
| 4,909,321 | 3/1990 | Petree | 166/72 |
| 4,997,041 | 3/1991 | Petree | 166/377 |
| 4,997,384 | 3/1991 | Godfrey et al. | 166/66.4 X |
| 5,109,921 | 5/1992 | Aracena | 166/65.1 |
| 5,278,550 | 1/1994 | Rhein-Knudsen et al. | 175/40 X |
| 5,358,418 | 10/1994 | Carmichael | 166/63.1 X |
| 5,363,921 | 11/1994 | Mendez | 166/377 |
| 5,568,836 | 10/1996 | Reid | 166/65.1 |

FOREIGN PATENT DOCUMENTS 2294714 5/1996 United Kingdom ..... E21B 17/06

OTHER PUBLICATIONS

NASA Conference Publication 3293; *Development of a High Force Thermal Latch;* William D. Nygren; 1995; (pp. 162–166).

*Primary Examiner*—Roger Schoeppel
*Attorney, Agent, or Firm*—Conley, Rose & Tayon, P.C.

[57] ABSTRACT

The wireline release includes a shaft having one end releasably connected to the end of the wireline by a connector and being held in the latched position by a fusible material ring. Upon activating heaters in the cable head from the surface via conductors in the wireline, the fusible material ring is melted allowing the shaft, under the tension of the wireline, to shift to an unlatched position whereby the connector releases the wireline from the shaft and cable head. The connector includes a plurality of collet members which, in the latched position, are biased into the connection with the end of the wireline and are then released upon being shifted to the unlatched position where the collet members move to a disengaged position.

43 Claims, 8 Drawing Sheets

CABLE HEAD

BACKGROUND OF THE INVENTION

The present invention relates to wireline connections for cable heads and more particularly to a release for releasing the wireline from the cable head.

Wireline operations are carried out in oil and gas wells for conveying tools downhole in the well. A wide variety of downhole tools may be supported on a wireline including tools to perform logging, setting and retrieving operations. The tools typically comprise a combination of different tubular members threaded together to form a working unit which is manipulated from the surface via the wireline. Although tools may be conveyed downhole on a tubing string which can withstand substantially higher extraction forces than a wireline, oftentimes a wireline is preferred because it saves substantial rig time in conveying tools downhole and positioning them within the well. A release is typically provided at the cable head, which connects the tools to the wireline, to permit the wireline to be disconnected from the tools such as when the tools become stuck downhole.

The safe pull of the wireline is a pull which does not exceed one-half the breaking strength of the wireline. When a tension is placed on the wireline which is over 50% of its break point, then problems begin to occur with the electrical conductors in the wireline. Also, there is the danger of breaking the wireline.

A typical wireline release is the use of a mechanical weak point in the connection between the wireline and the cable head. Typically this is a metal member which is designed to break upon a predetermined pull on the wireline. A safety margin is also required for the mechanical weak point and typically equals 66% of the amount of predetermined pull required to break the weak point and achieve a mechanical release. The correct conventional mechanical weak point must be calculated and installed prior to running the cable head and tools into the borehole on the wireline.

Thus, there are two limitations in using the typical conventional mechanical weak point release, one is the strength of the wireline itself and the other is the strength of the mechanical weak point. Assuming the cable head is located at the bottom of the borehole, the safe pull of the wireline is the lesser of 50% of the breaking strength of the wireline or 66% of the strength of the mechanical weak point plus the weight of the wireline suspended in the well. For example, assuming a 20,000 foot well, and a wireline having a break point of 22,000 pounds and a weight of 300 pounds per foot, the safe pull for the wireline is 11,000 pounds and the weight of the wireline will be approximately 6,000 pounds. Also, assuming the mechanical weak point is set at 5,000 pounds, then the safe point of the mechanical weak point is 66% of 5,000 or approximately 3,300 pounds. Thus, the limitation on the amount of pull which can be placed on the wireline is 9,300 pounds, i.e. 6,000 pounds for the weight of the wireline and 3,300 pounds for the safe pull of the mechanical weak point. In this example, the maximum pull, i.e. safe pull, on the wireline can be only 9,300 pounds. This example is over simplified because the friction of the system was not taken into account. In particular, if the cable head and tools are in a deviated hole, there may be a pull of 9,300 pounds at the surface with only 1,000 pounds being pulled on the cable head and tools because of friction on the wireline.

Various other apparatus and methods have been provided for releasing the wireline from the cable head and tools. One prior art method of releasing the wireline includes the use of a spring set at a particular tension. Once the force on the spring is exceeded, the wireline is released. This release still requires that the amount of load required to release the wireline be predetermined prior to lowering the cable head into the well. If the spring tension is exceeded, there can be a premature release of the cable head.

Another type of prior art release relies primarily on shear pins. Since wireline has fairly low tensile capabilities with respect to tubing, the shear screw or screws used in the prior art require a fairly low shear rating. This low shear rating was necessary to prevent damage to the wireline from excessive tensile stress should the downhole tool become stuck in the wellbore. Problems are encountered with shear screws having a low failure point because they are exposed to various cyclical forces which tend to affect their ultimate shear rating. The shear screws are exposed to fluids in the well which over time can affect the inherent strength of the shear screws or pins making them susceptible to failure at stresses below their rated failure point. Unexpected release can significantly delay operations, thereby costing significant sums. An unexpected release can also result in the loss of downhole tools and in extreme cases can cause severe damage to the wellbore which requires substantial time and money to repair.

It is not unusual for the cable head and tools to become stuck as they are being retrieved from the well. For example, where the pressure in the borehole is greater than the pressure in the formation, the drilling fluids tend to cake on the interior of the casing causing the tool to become lodged as it is retrieved. Further, the longer that the cable head and tool are stuck, the more difficult the retrieval becomes. Thus, it is desirable to remove the cable head and tools as soon as possible and this may be best accomplished if a high tension may be placed on the wireline. However, where a mechanical type release is used requiring the setting of the safe pull at the surface prior to lowering into the well, the amount of pull which can be applied to the wireline is limited to the safe pull of the release mechanism. Because the mechanical release has been set at a low value to insure that the wireline can be detached from the cable head at the deepest portion of the well without exceeding the maximum safe pull on the wireline, and because the length of the wireline has been reduced since the wireline may now be at a higher elevation within the borehole, only a limited amount of the safe tensile load of the wireline may be used to dislodge the cable head and tools. Any greater pull may break the mechanical release and prematurely release the cable head and tool. Thus, it is desirable to have available the maximum amount of pull possible for retrieving the cable head and tool. Further, once the cable head becomes stuck using a conventional mechanical release, the amount of safe pull must be calculated based on the depth of the cable head in the well.

Using the conventional mechanical release, a high tension must be placed on the cable to exceed the tensile strength and break the weak point. Upon breaking the mechanical release, a large shock is imparted to the cable head because of the large tension on the wireline. For example, when the cable head is stuck, the operator will fish for the tool with the wireline left in the hole. The operator lowers a grapple which grabs the top of the cable head or the tool body. Once the tools are grabbed, the operator wants to release the wireline and remove it from the hole. This makes it a lot easier to pull the tools and pipe out of the well. Thus, the operator places a large tension on the wireline to activate the mechanical release.

Other apparatus and methods are used which do not require a mechanical break point setting. One method includes attaching at the surface a cutter tool which slides down the wireline cutting the wireline on impact at the connection of the wireline to the cable head. However, time is lost when attaching such a cutter tool since the blowout preventer has to be sealed across the wire to hold back well pressure while the tool is attached to the wireline. Another disadvantage is that the cutter tool may cut the wire prematurely if it hits a restriction on its way downhole.

Another type of prior art release includes the use of bolts which are exploded to disconnect the wireline from the cable head. Explosive bolts have the advantage of allowing the application of tension on the wireline up to the amount of safe pull permitted for the wireline. However, one disadvantage is that once the signal to detonate the explosive bolts has been sent from the surface, the detonation cannot be terminated. There are concerns that the explosive bolts will prematurely detonate accidentally releasing the cable head from the wireline. Further, many safety concerns arise in using explosive bolts. A dangerous material must be used for exploding the bolts and thus requires an explosive device to be housed within the cable head. Also, there are safety issues in storing a cable head having an explosive device. Such a release system requires that many safety devices be used to ensure that adequate safety is provided.

In yet still another prior art release, a spring loaded piston is used which can be activated by pressuring up the wellbore and applying the pressure to the piston. However, the release can be prematurely activated by encountering a higher pressure downhole. In particular, the deeper the cable head is lowered into the well, the higher the borehole pressure.

In another prior art apparatus, the cable head includes a plurality of full diameter sections with one of the sections being released. However, a fall diameter tubular member is more difficult to retrieve from the well.

Major problems occur if the cable head and tools get stuck in the well and the wireline breaks upon pulling on the wireline with too much tension. Breaking the wireline and dropping the wireline in the well greatly complicates the fishing operation to retrieve the tools.

The present invention overcomes the deficiencies of the prior art.

SUMMARY OF THE INVENTION

The wireline release of the present invention includes a shaft having one end releasably connected to the end of the wireline by a connector and being held in the latched position by a fusible material ring. Upon activating heaters in the cable head from the surface via conductors in the wireline, the fusible material ring is melted allowing the shaft, under the tension of the wireline, to shift to an unlatched position whereby the connector releases the wireline from the shaft and cable head. The connector is a collet connector having a plurality of individual members which, in the latched position, are biased into the connection with the end of the wireline and are then released upon being shifted to the unlatched position where the collets move to a disengaged position.

One of the advantages of the release of the present invention is that the only limitation on the safe pull of the wireline is the breaking strength of the wireline. No mechanical weak point is used having a predetermined break strength. Thus, a much greater tension may be placed on the wireline from the surface to retrieve a cable head and tools which have become stuck in the well.

Another advantage of the release of the present invention is that it is not an automatic release and will only release the wireline upon command from the operator at the surface. Further, the release is reusable.

The cable head of the present invention provides redundant circuitry and conductor utilization to ensure the ability to heat the fusible material and activate the release. Two latching relays are used to switch separate electrical lines to the heaters. Further, the heater includes two different heater coils and the wireline provides four conductors to power the heater coils. Also, the conductors are isolated by diodes from the heater coils to keep a shorted line from disabling one of the heaters.

After a cut and thread fishing operation, any combination of conductors 1–6 can be used to power the heater coils 194, 196.

The cable head of the present invention also includes safeguards against accidental release. The use of the fusible material as release mechanism is simple and safe.

The cable head of the present invention has the further advantage of reduced shock upon release of the wireline as compared to the shock caused by the breaking of a conventional weak point. The breaking strength of a conventional mechanical weak point must be exceeded while the present invention only requires a minimum tension on the wireline to operate the release.

Other objects and advantages of the invention will appear from the following description.

BRIEF DESCRIPTION OF THE DRAWINGS

For a detailed description of a preferred embodiment of the invention, reference will now be made to the accompanying drawings wherein.

DESCRIPTION OF THE PREFERRED EMBODIMENT

Figure 1:
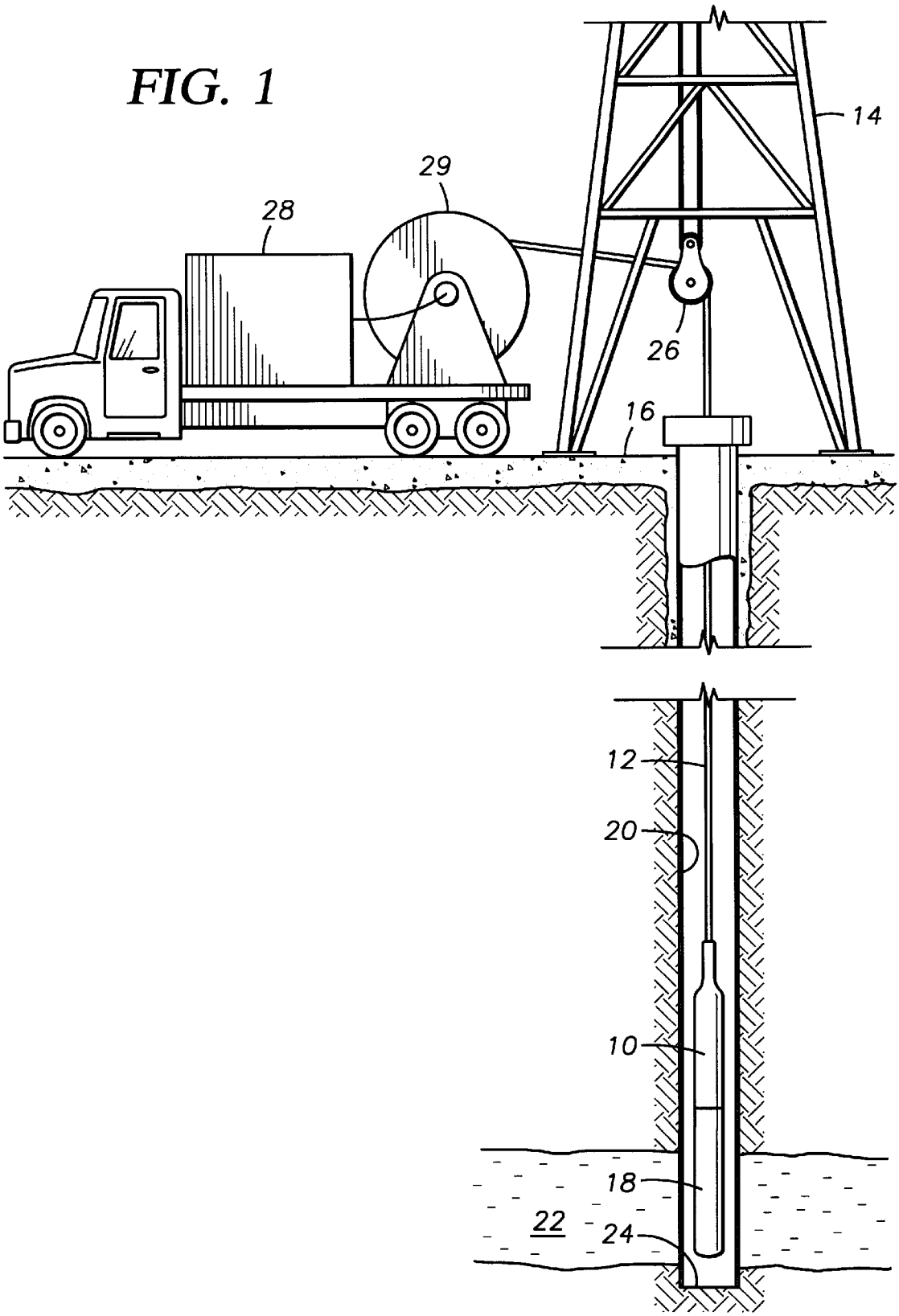
FIG. 1 is a schematic illustrating the cable head of the present invention disposed within the borehole of a well.
Figure 2A:
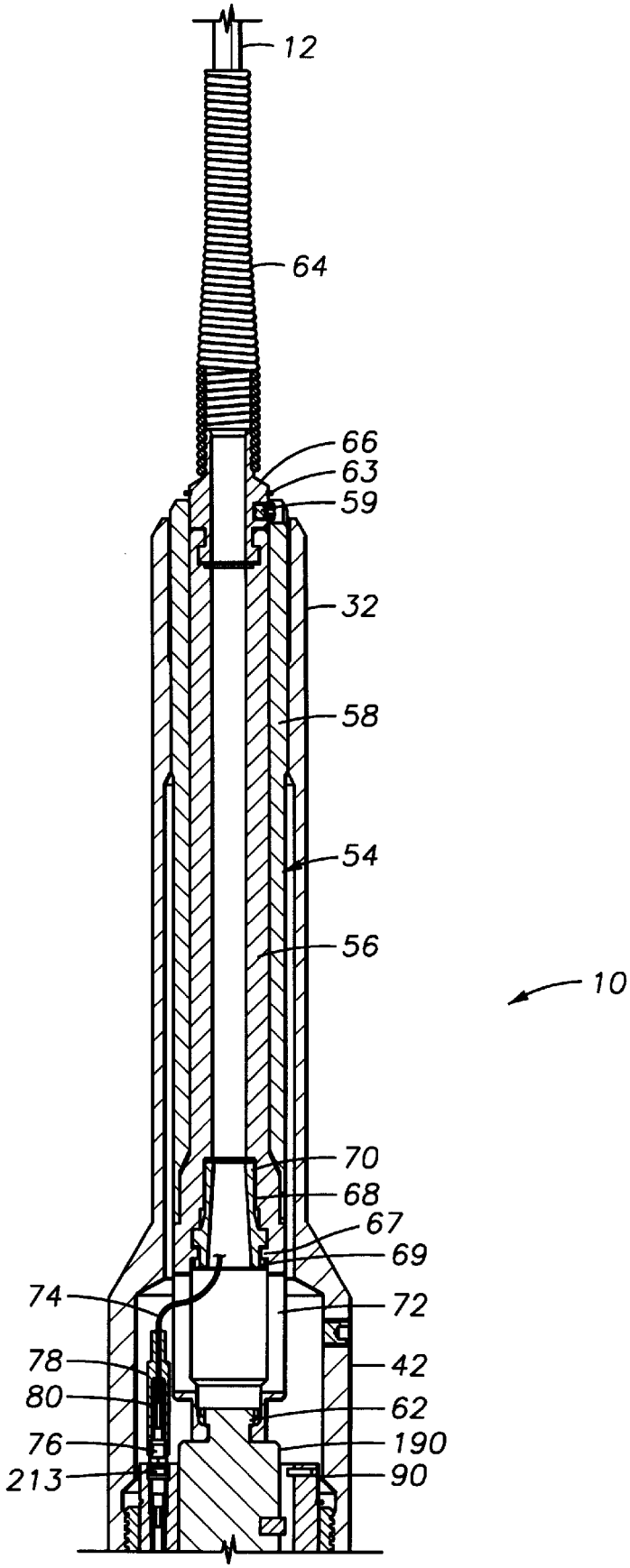
FIGS. 2A–D are a cross-section of the cable head of the present invention suspended by a wireline and supporting a string of tools.
Figure 2B:
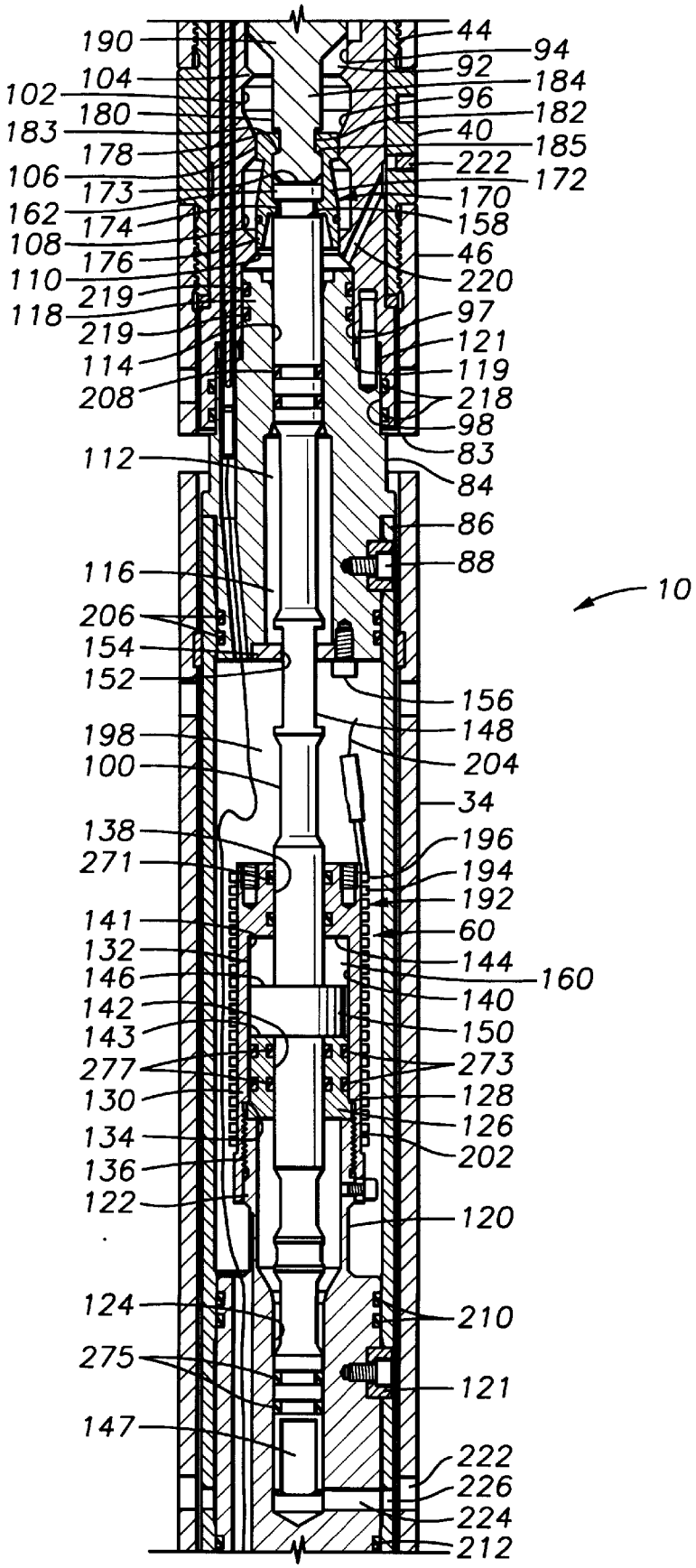
Figure 2C:
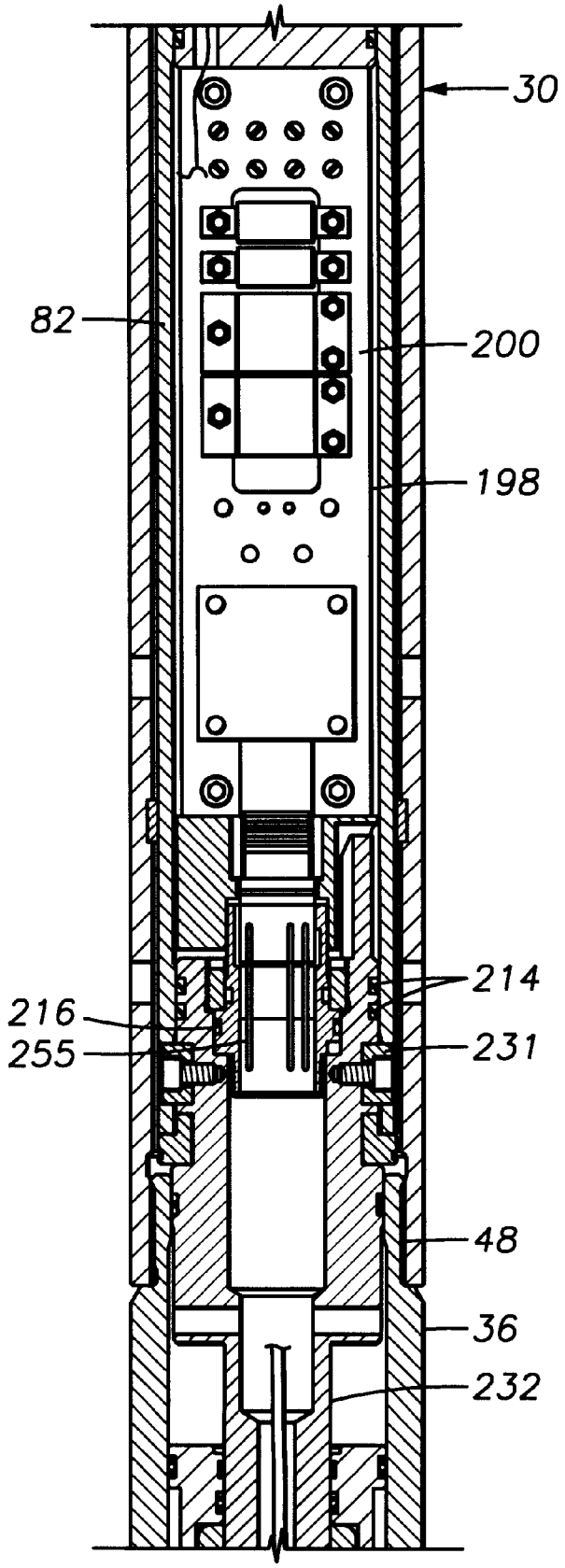
Figure 2D:
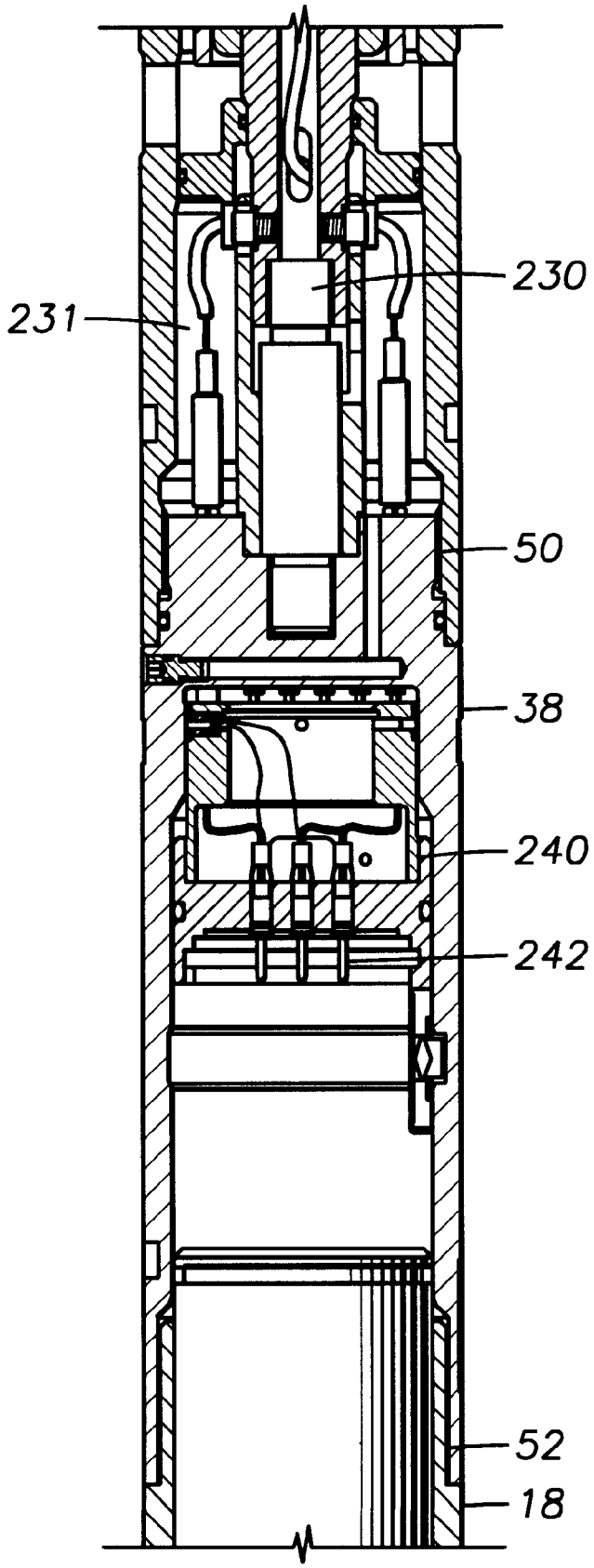

Referring initially to FIG. 1, there is shown schematically a cable head 10 supported by a wireline 12 from a rig 14 at the surface 16. The cable head 10 supports a tool string 18 disposed adjacent a production zone 22 located, as for example, near the bottom 24 of borehole 20. The wireline 12 is disposed around one or more sheave wheels 26 to a wireline vehicle 28 having instrumentation well known in the art.

The rig 14 includes a load cell (not shown) which determines the amount of pull on wireline 12 at the surface of the borehole 20. The instrumentation of wireline vehicle 28 includes a safety valve which controls the hydraulic pressure that drives the drum 29 on the wireline vehicle 28 which reels up the wireline 12. The safety valve is adjusted to a pressure such that the drum can only impart a small amount of tension to the wireline 12 over and above the tension necessary to retrieve the wireline 12, cable head 10, and tool string 18 from the borehole 20. The safety valve is typically set a few hundred pounds above the amount of desired safe pull on the wireline 12 such that once that limit is exceeded, further pull on the wireline is prevented.

Wireline 12, sometimes referred to as a cable, typically includes a plurality of electrical conductors extending from the wireline vehicle 28 to the cable head 10, all well known in the art. One such type of wireline 12 includes an inner core of seven electrical conductors covered by an insulating wrap. An inner and outer steel armor sheath is then wrapped in a helix in opposite directions around the conductors. The electrical conductors are used for communicating power and telemetry between the wireline vehicle 28 and tool string 18.

Referring now to FIGS. 2A–D, wireline 12 is shown supporting cable head 10 which in turn threadingly supports tool string 18, such as logging, setting and retrieving tools, at its lower end. Cable head 10 includes an outer housing 30 made up of a connecting head 32, a latch housing 34, an extension housing 36, and a pressure housing 38. Connecting head 32 includes a coupling sub 40 threadably mounted at 44 on the main body 42 of head 32. Coupling sub 40 includes threads for threaded connection at 46 to the upper end of latch housing 34. A slotted space 83 is provided in latch housing 34 for receiving a support member (not shown). Extension housing 36 is threaded at 48 onto the lower end of latch housing 34 and pressure housing 38 is threaded at 50 onto the lower end of extension housing 36. The tool string 18 is mounted at 52 onto the lower end of pressure housing 38.

The lower end of wireline 12 is connected to the upper end of latch assembly 60 by means of a connector assembly 54. Connector assembly 54 includes a split sleeve 56 disposed within a retainer sleeve 58. The lower end of split sleeve 56 is connected to anchor member 190. The lower end of wireline 12 extends through spring 64 which is attached to split sleeve 56 by spring retainer 66. The wireline 12 is disposed between the two halves of split sleeve 56 with its terminal end feeding through flanged head 68 disposed in the rope socket 70 formed in sleeve 56. Conical wedges are driven into the end of the wireline 12 between the armor sheaths to mechanically attach the terminal end of wireline 12 to flanged head 68. The greater the tension on wireline 12, the greater the wedging effect of the two conical wedges.

Retainer sleeve 58 slides over split sleeve 56 to retain spring retainer 66, flanged head 68, and anchor member 190. The lower end of sleeve 56 has inwardly directed flanges which fit around the flanged head 62 of anchor member 190. Anchor member 190 is connected to the upper end of latch assembly 60. Dogs 67 and slot 69 in sleeve 56 and head 68, respectively, prevent sleeve 56 from rotating with respect to head 68. Relative rotation would twist conductors 74. A screw 59 and a retaining ring 63 attaches sleeves 56 and 58.

Slots 72 are provided in the lower end of split sleeve 56 to allow the conductors 74 of wireline 12 to pass through aperture 72 for electrical connection with the cable head 10. The terminal end of each individual conductor 74 passes through an insulated boot or sleeve 78 for attachment to a socket connector 80. Socket connector 80 is attached to connector 76 mounted in the upper end of latch sleeve 90.

Latch assembly 60 includes an inner housing 82 disposed within outer housing 30. A top sub 84 is keyed axially at 86 onto the upper end of inner latch housing 82 to prevent rotation and is retained by cap screw 88. A feed through latch sub 90 is mounted on the upper end of top sub 84. Latch sub 90 is generally cylindrical forming a bore 92 having an upper cylindrical portion 94, a medial portion with a predetermined contoured, internal profile 96, and first and second enlarged diameter portions 97 and 98.

Internal profile 96 of bore 92 includes an upper enlarged portion 102 forming a stop shoulder 104 and a restricted diameter portion forming an inwardly facing upper annular shoulder 106. A lower enlarged portion 108 also forms annular shoulder 106 at its upper end and has a lower restricted diameter portion forming an inwardly facing lower annular shoulder 110.

Top sub 84 is also generally cylindrical and has a bore 112 therethrough. Bore 112 includes an upper smaller diameter bore 114 and a lower enlarged diameter bore 116. The upper end of sub 84 includes a reduced diameter nose 118 which is slidingly received within the first enlarged bore 97 of latch sub 90. A retainer socket/washer 121 is disposed between an upwardly facing annular shoulder 119 formed by nose 118 and the downwardly facing shoulder formed by the transition between first and second enlarged portions 97, 98.

Latch 60 also includes an anchor sub 120 keyed within the inner latch housing 82. Anchor sub 120 has a tensile strength greater than the safe pull of the wireline 12. Anchor sub 120 includes a neck portion 122 and a bore 124 extending through neck 122 and into the body of anchor sub 120. A latch housing 130 is threaded at 136 onto neck 122 of anchor sub 120 and includes a blind bore 132 which is adapted to receive a seal plug 126. Seal plug 126 has an enlarged end forming an annular shoulder 128 which engages a shoulder 134 in latch housing 130. A coaxial bore 138 extends through counterbore 132 and has a reduced diameter. Seal plug 126 also includes a bore 142 which is coaxial with bore 138. Counter bore 132 and seal plug 126 form a chamber 140.

Latch assembly 60 includes a latch shaft 100 which extends from sub 120 to latch sub 90. Shaft 100 extends through bore 124 in anchor sub 120, through bore 142 in seal plug 126, through chamber 140 of counter bore 132, through bore 138 in latch housing 130, through bore 112 in top sub 84, and into bore 92 of latch sub 90. Shaft 100 includes an enlarged diameter portion 150 which forms a lobe or collar disposed within chamber 140 of latch housing 130. The collar 150 has a interference fit with the inner wall of member 130 when at room temperature.

Collar 150 divides chamber 140 into two sub chambers, 141 and 143. The upper sub chamber 141 contains fusible material 160 when the latch assembly 60 is in the latched position. In the latched position, the volume of the lower sub chamber 143 is substantially zero. When the fusible material 160 melts and the shaft 100 moves to the unlatched position, the collar 150 moves along with it. The movement of collar 150 forces the melted fusible material to flow from sub chamber 141 to sub chamber 143. The total volume of chamber 140 remains constant and is the sum of sub chambers 141 and 143. The volumes of sub chambers 141 and 143 vary with the position of collar 150.

A ring of fusible material 160 is disposed around shaft 100 and between the top 144 of chamber 140 and the upwardly facing side 146 of collar 150. Material 160 is placed in compression by collar 150 as tension is applied to wireline 12. The preferred alloy for fusible material 160 is 96½% tin and 3½% silver.

Shaft 100 includes flats 147 on its lower end which cooperate with a pin in anchor member 120 and also includes flats 148 which are keyed to a rectangular slot 152 in a stop block 154, fastened by cap screws 156 into the lower end of top sub 84. These flats are provided to prevent shaft 100 from rotating. The upper end of shaft 100 includes an annular groove 158 forming a head 162.

A latch connector, such as a collet connector 170, is mounted around the upper end of shaft 100. Collet connector 170 has a plurality of releasing elements in the form of individual elongated members 172, preferably 8 in number, for connecting shaft 100 to anchor member 190. Each member 172 includes an inwardly directed tine 174 which is received within annular groove 158 of shaft 100. Each member 172 includes a tail 176 at its lower end and a head 178 at its upper end having an inwardly directed flange 180 adapted to be received within a groove 182 formed in neck 184 of anchor member 190. Flange 180 forms a downwardly facing arcuate shoulder 185 which tapers upwardly and inwardly for engagement with an upwardly facing annular shoulder 183 which tapers downwardly and outwardly. The tapered surfaces on shoulders 183, 185 form cooperating cam surfaces allowing members 172 to cam outwardly upon the release of collet connector 170 as hereinafter described in further detail.

In the lower latched position shown in FIG. 2A–D, the shaft 100 is in its lowermost position. In its lowermost position, collet connector 170 is latched and connected to anchor member 190 due to the positioning of the members 172 with respect to the internal profile 96 of latch sub 90. In the latched position, tail 176 bears against shoulder 110 and head 178 bears against shoulder 106 thereby causing tine 174 to be maintained within groove 158 and flange 180 to be maintained within groove 182 of anchor member 190 with shoulders 183, 185 in engagement. Since anchor member 190 is connected to connector assembly 54 by split member 56, shaft 100 latches cable 12 to cable head 10.

Latch assembly 60 further includes heaters 192 comprised of two helically wound, independent coils 194, 196 for heating fusible material 160. Heaters 192 are disposed within the bore 198 formed by inner latch housing 82, sub 84, and anchor sub 120. Helical coils 194, 196 are disposed around the external surface 202 of latch housing 130 and preferably have a rectangular cross-section such that the inner surface of the coils are in contact with the external surface 202 of latch housing 130 thereby providing good heat conductivity. One preferred type of coil is Model No. 125 PS 30A 48A, 240 volt, 450 watt coil manufactured by Watlow Manufacturing Co., Inc. of St. Louis, Mo.

Heaters 192 are electrically connected by conduits 204 to switching chassis assembly 200 which is disposed within bore 198 of inner latch housing 82 below anchor member 120. Heater coils 194, 196 are independent and are powered by separate conductors in wireline 12 so as to provide redundant heaters for heating fusible material 160.

That portion of bore 198 housing heaters 192 and that portion of the bore 198 housing switching chassis assembly 200 are maintained at atmospheric pressure. Thus, these chambers are sealed off from the borehole pressure by O-ring seal members 206, 208, 210, 212, 214, 216, 218, 219, and 275. Connector 172 is subjected to borehole pressure by means of ports 220 and 222 passing through latch sleeve 90 and coupling sub 40, respectively. Connector 172 is also exposed to borehole pressure through bore 92. Because the upper end 173 of shaft 100 is subject to borehole pressure, it is necessary that the lower end of shaft 100 also be subject to borehole pressure. Thus, ports 224, 226, and 222 are provided through anchor sub 120, inner latch housing 82, and outer housing 30, respectively. Thus, these ports balance the borehole pressure on shaft 100.

A load cell 230 is disposed in chamber 231 below switching chassis assembly 200 for measuring the tension on the wireline 12 downhole at the cable head 10. Chamber 231 is filled with hydraulic oil so that pressure does not affect the readings of the load cell 230. A train of connected members extends from load cell 230 to the end of cable 12 so that load cell 230 can measure the tension on wireline 12 downhole. This train, starting from the end of cable 12, includes connector assembly 54, anchor member 190, latch connector 170, shaft 100, fusible ring 160, latch housing 130, anchor sub 120, housing key 121, inner housing 82, housing key 231, and piston mandrel 232. Thus, the tension on wireline 12 is passed directly to load cell 230 located at the lower end of cable head 10. The tool string 18 is mounted on the pressure housing 38 allowing this train of members to transmit tension to load cell 230.

It is desirable to measure the tension on the wireline 12 both at the surface 16 and at the cable head 10. The load cell on the rig 14 at the surface 16 determines the amount of pull at the surface. The amount of tension lost due to friction is not known, particularly when the cable head 10 and tools 18 are pulled against the side of the borehole 20. Sometimes in a deviated hole, the wireline 12 wears a key seat or groove in the borehole 20 creating additional friction. The wireline 12 can get jammed and stuck in the key seat. The pull measured at the surface only goes to the point where the wireline 12 is stuck. In that situation, no force then is transmitted down to the cable head 10 and tools 18. So with the load cell 230 in the cable head 10 measuring the tension at the cable head 10, the operator can determine whether there is any tension at the cable head 10 and thus determine whether the wireline 12 is stuck between the cable head 10 and the surface 16.

The cable head 10 includes a plug in module assembly 240 having a plurality of connectors 242 for electrical connection with the tools 18 supported at the end of cable head 10. The connectors 242 of module assembly 240 are electrically connected to switching chassis assembly 200. It can be seen, as is well known in the art, that the cable head 10 provides electrical connection between the conductors of wireline 12 and the electrical systems in tools 18.

Figure 3A:
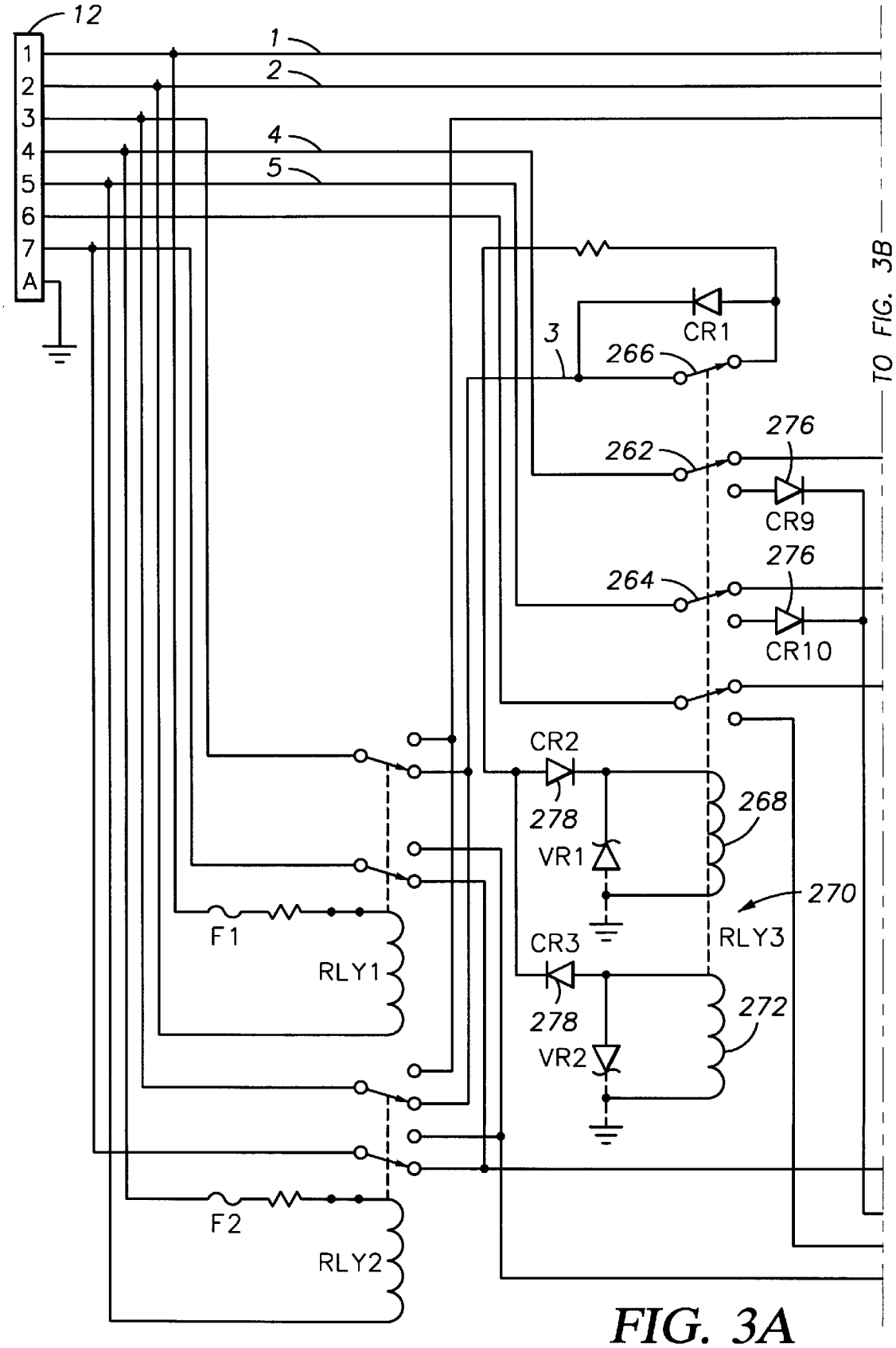
FIG. 3A and B is an electrical diagram showing the electric circuit for activating the heaters.
Figure 3B:
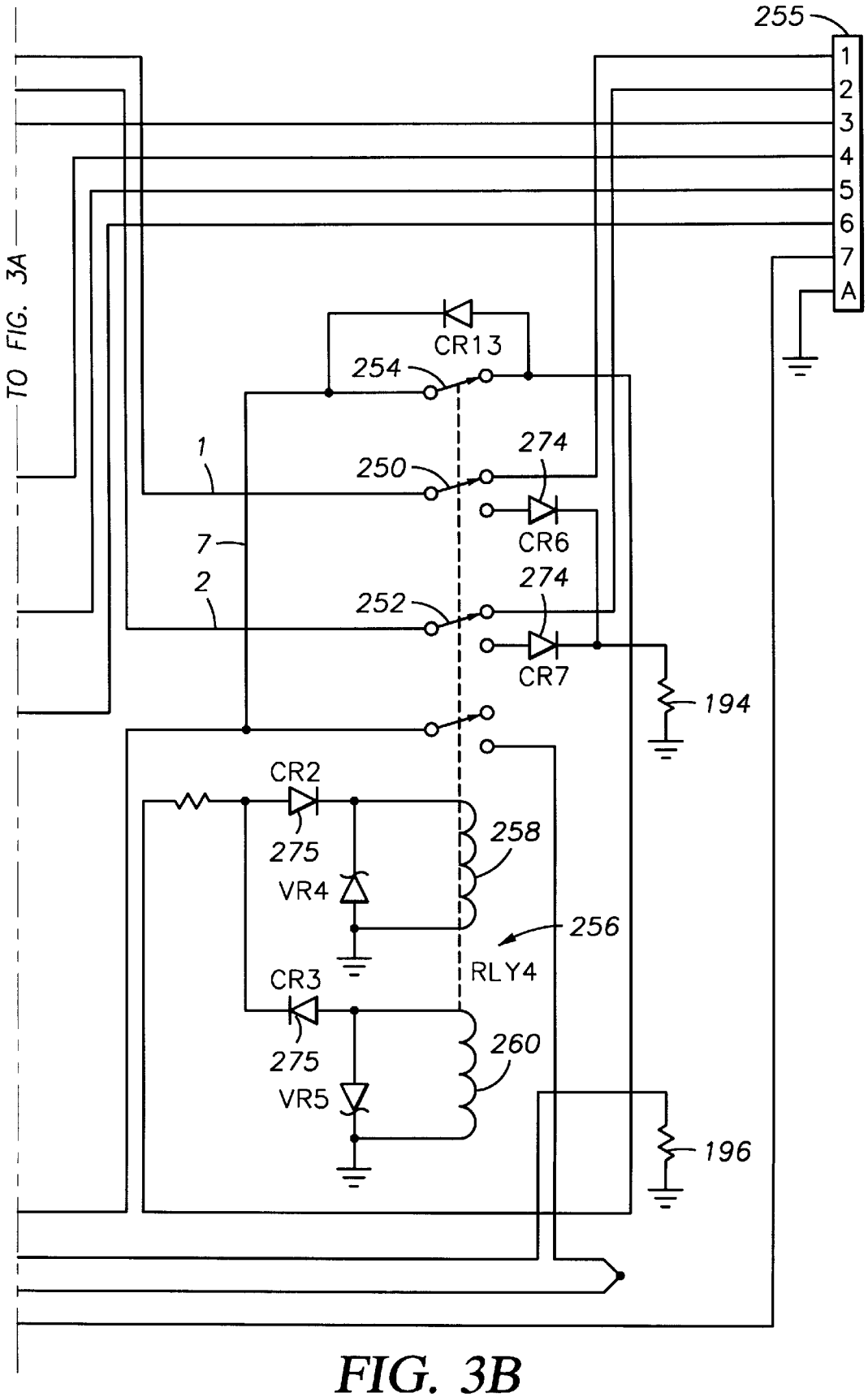

Referring now to FIG. 3, there is shown a circuit diagram for that portion of the circuitry of switching chassis assembly 200 which relates to the heaters 192 and includes a plurality of printed circuit boards and relays. The left-hand rectangular box in FIG. 3 designates the seven conductors from wireline 12 including the ground A. Conductors 1–7 feed through the circuitry to the seven connectors of plug-in module assembly 240 shown in the right-hand rectangular box in FIG. 3. The relays and latch switches are used to switch the conductors from the tool string 18 to the heaters 192. There are two sets of relays with one conductor to activate each set of relays which then activate the latch switches to switch the current from the tools 18 to the heaters 192. Once the relays have been activated, two other independent conductors are connected to each heater coil 194, 196.

As shown in FIG. 3, conductors 1 and 2 feed through latching switches 250, 252, respectively. Latching switches 250, 252 are normally in the log position connecting conductors 1 and 2 to electrical connectors 255 which in turn are electrically connected to connectors 242 of plug-in module assembly 240. Conductor 7 feeds through to switch 254 which activates the release coil in relay 256. A positive electrical pulse through conductor 7 passes through 254 and powers release coil 258 which causes latching switches 254, 250, and 252 to move to the release position which connects conductors 1 and 2 to heater coil 194. A negative pulse through conductor 7 then activates log coil 260 for switching the latching switches 250, 252, 254 back to the log position.

Likewise, conductors 4 and 5 feed through latching switches 262, 264 for turning on heater coil 196. Conductor 3 feeds through switch 266 which activates release coil 268 in relay 270. Release coil 268 then activates latching switches 262, 264, and 266 for turning on heater coil 196. Relay 270 includes a log coil 272 for switching latches 262, 264, and 266 back to the log position. One heater coil is sufficient to heat and melt the fusible material 160 and release wireline 12.

The heater coils 194, 196 are isolated by diodes so that if one of the wireline conductors is shorted out, the heater is not shorted. If one of the lines is shorted, the result is that that conductor is no longer used to power one of the heater coils. Diodes 274 isolate any short circuit in the line to heater coil 194 whereby if one of the lines shorts out, the positive direct current passes through the diode and goes to the heater coil 194 and the other diodes block the positive direct current from the short in the line. Similarly, diodes 276 are provided to block current due to a short in the line for heater coil 196. The release and log coils 258, 268 and 260, 272 of relays 256 and 270, respectively, also have diodes 275, 278, respectively, for directing the positive and negative pulses through conductors 7 and 3, respectively, to the release coils 258, 268 and the log coils 260, 272.

In operation, the operator at the surface sends a positive pulse through conductors 3 and 7 to relays 256, 270 and thus latch switches 250, 252 and 262, 264 to direct current to heater coils 194, 196, respectively. The heater coils 194, 196 of heater 192 being wrapped around and in contact with the external surface 202 of latch housing 130 heats the metal of latch housing 130. At room temperature, there is an interference fit between collar 150 and the internal wall of housing 130. However, latch housing 130 has a higher coefficient of expansion than that of collar 150. Thus, as housing 130 is heated by heaters 192, latch housing 130 expands to a greater degree than collar 150 thereby forming a clearance or gap between latch housing 130 and collar 150. The fusible material 160 then melts and flows through the clearance or gap into the lower portion of chamber 140 with the clearance only being a few thousandths of an inch. Chamber 140 is sealed by seals 271, 273, and 277 thereby containing the melted fusible material within chamber 140.

The tension on wireline 12 causes shaft 100 to move upwardly as the melted fusible material 160 flows around collar 150. This causes latch 60 to move from the latch to the unlatched or released position.

Figure 4A:
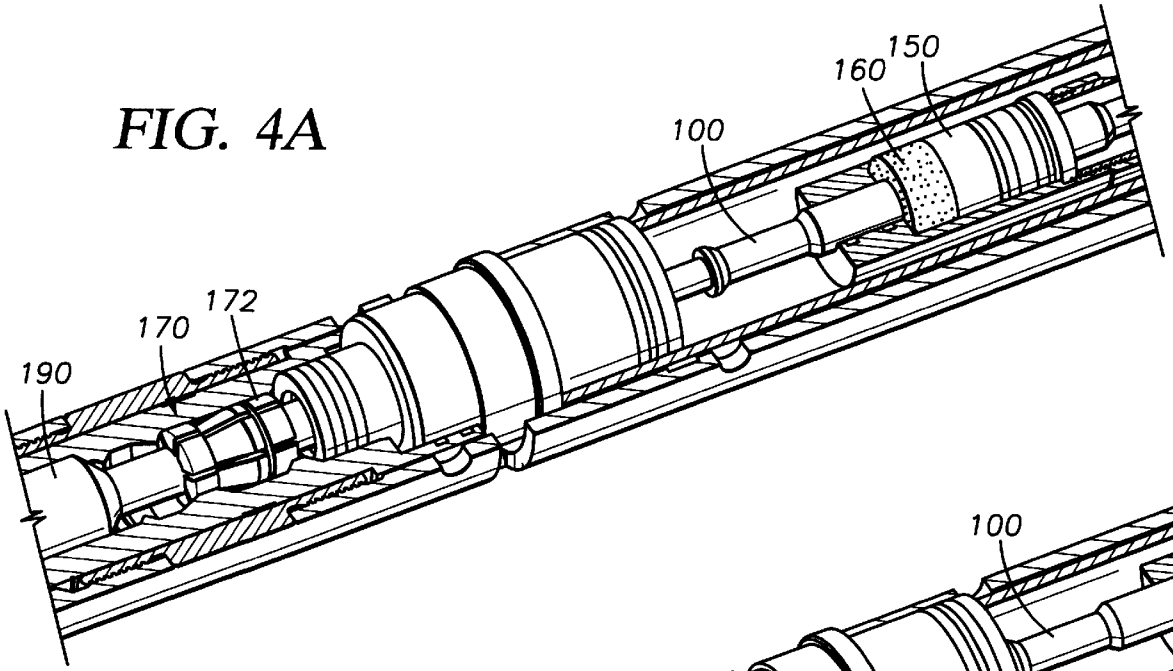
FIGS. 4A and B illustrate the cable head of the present invention in both the latched and unlatched positions.
Figure 4B:
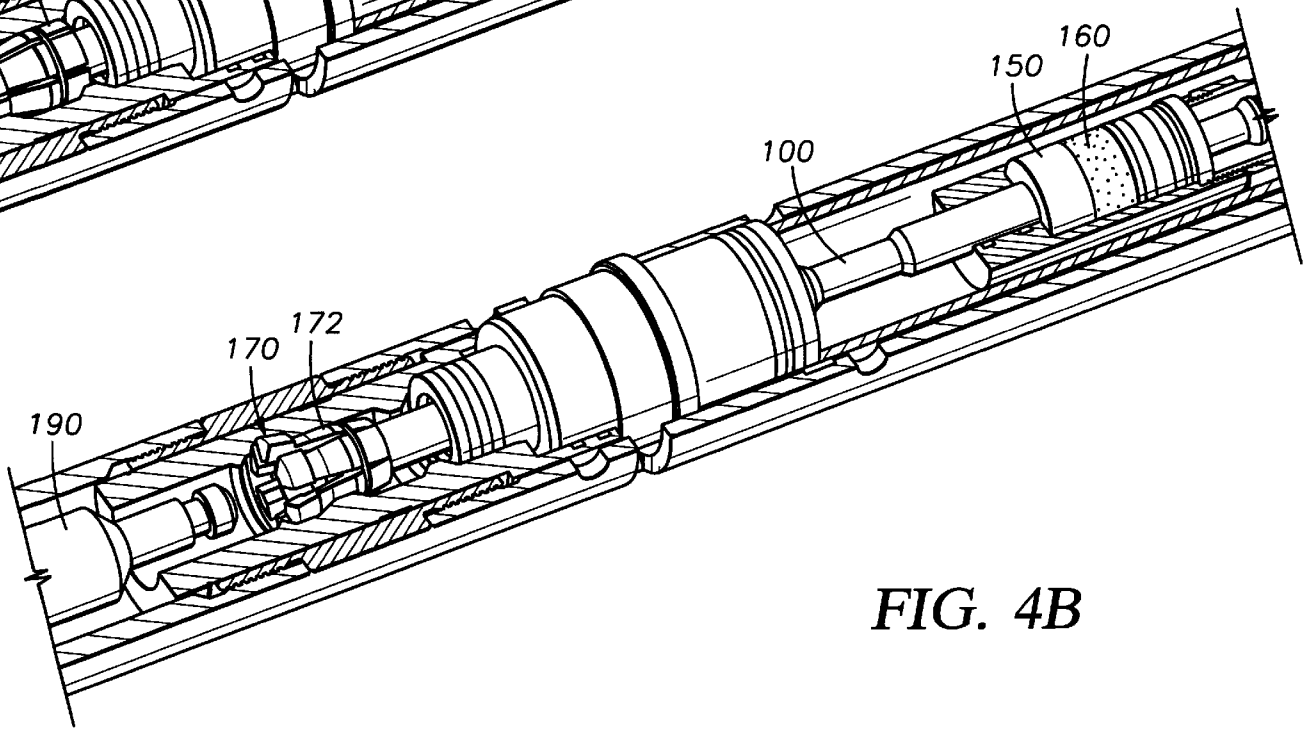

Referring now to FIG. 4B, shaft 100 is shown in the uppermost position with latch 60 in the unlatched position. As best shown in FIG. 4B, as shaft 100 moves upwardly, the members 172 of connector 170 are moved upwardly due to the engagement of tines 174 in groove 158. The contour of internal profile 92 allows the collet connector 170 to open. An upwardly facing angled shoulder 183 is provided on the lower end of groove 182 to match the downwardly facing angled shoulder 185 on the lower end of the inwardly directed flange 180. Head 178 moves off of shoulder 106 and tail 176 moves off of shoulder 110 and into enlarged diameter portions 102, 108, respectively. As head 178 moves off of shoulder 106, the angled shoulders 183, 185 impart an outward radial force to head 178 causing them to pivot on tine 174 and cam head 178 out of groove 182 thereby releasing anchor member 190 from shaft 100. Once the dogs 180 pivot and cam outwardly out of groove 182 in anchor member 190, anchor member 190 together with the connector 54 on the end of wireline 12 are disconnected and released from cable head 10. Further, as the disconnection takes place, the connectors 80 on conductors 74 of wireline 12 are disconnected from socket connector 76 thereby disconnecting all of the conductors 74 from cable head 10. This disconnection also disconnects the heater coils 194, 196 of heaters 192 from the power supplied through wireline 12. The fusible material 160 then solidifies in the lower portion of chamber 140 underneath collar 150 locking shaft 100 in the unlatched position.

Once the cable head 10 is recovered from downhole, the connectors 80 on conductor 74 are reconnected to connector 76 and the heaters 192 are again turned on to reheat fusible material 160. A force is placed on the end of shaft 100 causing it to move downwardly to the latched position as the melted fusible material 160 flows around collar 150 to the upper end of chamber 140. The heaters 192 are then turned off allowing the fusible material 160 to again solidify in the latched position. This permits cable head 10 to then be reused.

Alternatively, a spring may be provided below seal plug 126 to reset shaft 100 while the cable head 10 is downhole. Shaft 100 would be shifted by the spring while the fusible material 160 was still melted and in a liquid stage.

The fusible metal 160 is a eutectic alloy whose solidus and liquidus temperatures are the same, i.e. preferably 430° F. The safe temperature to hold a load must be somewhat below the solidus temperature. The temperature must reach the liquidus to allow the shaft 100 to stroke fully and ensure proper release of connector 170. Most fusible alloys are non-eutectic. Their solidus and liquidus vary from each other by a few degrees to well over 100°. The use of a non-eutectic material would require that the fusible material 160 be heated to a greater temperature differential above the safe operating temperature of the cable head 10. The higher the temperature to operate the latch assembly 60, the greater demands that are placed on the seals and other materials in that portion of the latch assembly 60 which is heated. It also requires greater time to reach the release temperature. Using a eutectic alloy minimizes the temperature differential between safe operating temperature and the release temperature. This minimizes the demands on the seals and extends the number of release-reset cycles that may be achieved without rebuilding that portion of the cable head 10.

Further, the heated section of the latch 60 is designed to minimize conductive heat transfer away from the fusible material 160. This reduces the power requirements on the heaters 192. It also minimizes the operating temperature of the pressure seals that maintain atmospheric pressure inside the inner housing 82. Heat transfer is minimized by having reduced diameter portions in shaft 100 and neck 122 of anchor sub 120 that the thermal latch housing 130 attaches to. The length of the neck 122 and the shaft 100 before they contact a massive amount of material also contributes to a decrease in thermal conduction away from the fusible material 160. The thermal latch housing 130 is made from a material having a high heat conduction. The shaft 100 and anchor sub 120 are made from materials with low heat conduction.

The seals 271, 273, 277 that contain the fusible material 160 inside chamber 140 are not high pressure seals. These seals do not play a role in holding the load. The latch assembly 60 may be subjected to high loads and at a temperature above the operating temperature of the cable head 10, typically 350° F., and below the melting point of the fusible material 160, i.e., preferably 430° F., for a long period of time with no adverse affects. Thus, the failure of the seals 271, 273, 277 around the fusible chamber 140 will not cause the latch assembly 60 to fail. If the seals 271, 273, 277 fail, the failure merely allows the melted fusible material 160 to escape from chamber 140 during the release cycle and will have to be replaced prior to cable head 10 being reused.

The cable head 10 of the present invention permits the release of wireline 12 with a low tension on wireline 12. The only tension required is a nominal tension, such as less than 1000 pounds, which is sufficient to cause shaft 100 to shift upwardly upon the melting of fusible material 160. This nominal tension must be great enough to overcome the friction of the shaft 100, i.e., friction between the shaft 100 and the seals 208, 271, 275, and 277. The tension must also be adequate to squeeze the melted fusible material 160 around collar 150. By allowing the release to occur using a low tension on wireline 12, the shock on cable head 10 is substantially reduced at the time of the release. A large tension on wireline would impart an undesirable large shock to the cable head. A large shock might cause the tools 18 to be released from the grapple of a fishing tool, for example.

The cable head 10 could be released with zero tension on wireline 12 by providing an alternate means of causing the shaft 100 to move upwardly. Such a force could be provided by a spring engaging shaft 100 so as to apply an upward biasing force on shaft 100 and pushing shaft 100 in an upward direction.

Although typically unnecessary and not preferred, a mechanical weak point release may be used between connector assembly 54 and anchor member 190 as a backup to latch assembly 60. The use of a back-up mechanical weak point would be based on particular well conditions so as to provide an additional safety factor which will allow another method of releasing the wireline from the cable head if necessary. However, the mechanical weak point would still require a 66% safety margin thus limiting the amount of pull which could be applied to wireline 12.

The cable head 10 of the present invention allows a delay period between activating the heaters 192 and the melting of the fusible material 160 to activate the latch assembly 60. During that delay period, the operator at the surface can still abort the release of the wireline 12 by turning off the heaters 192 and allowing the fusible material 160 to cool and maintain shaft 100 in its latched position. The amount of time required to melt fusible material 160 is determined by the ambient temperature downhole around cable head 10 and the current supplied through the wireline conductors 74 to the heaters 192. Assuming the fusible material 160 has a melting temperature of 430° F. and assuming the initial temperature at the cable head 10 is 75° F., then the amount of time required to melt the fusible material 160 will be approximately five minutes. Thus, the operator would have five minutes after activating the heaters 192 to abort the release of wireline 12.

Since the fusible material 160 has a melting point of 430° F., and the operating temperature is typically 350° F. or less, at least an 80° differential is provided between the operating temperature of the cable head 10 and tools 18 and the melting point of the fusible material 160.

It should be appreciated that other shifting means may be used to shift the shaft 100 in response to an electrical signal from the surface. Other such means include hydraulic actuation, an electric motor, a solenoid, a spring release, or a combination thereof. Also means other than shifting means may be used to cause shaft 100 or some other member to actuate the connector 170 from the latched to the unlatched position.

It should also be appreciated that shaft 100 can remain stationary with the part having internal profile 96 shifting by any of the previously mentioned methods to actuate the connector and accomplish the release.

While a preferred embodiment of the invention has been shown and described, modifications thereof can be made by one skilled in the art without departing from the spirit of the invention.

What is claimed is:

1. An apparatus for releasably connecting a wireline to a downhole tool for raising and lowering the downhole tool within a well, comprising:

a connector having a first portion adapted for connection to the downhole tool and a second portion adapted for connection to the wireline, said connector having a connected position connecting said first and second portions and an unconnected position releasing said first and second portions;

a non-explosive release disposed on said connector and maintaining said first and second portions in the connected position, said non-explosive release adapted to be electrically connected to the wireline, said release electrically activated by the wireline to actuate said connector to said unconnected position releasing said first and second portions;

said second portion having a substantially smaller radial dimension than the downhole tool.

2. The apparatus of claim 1 with the wireline having a safe load, wherein said connector has a tensile strength greater than that of the safe load of the wireline.

3. The apparatus of claim 1 wherein said release includes a fusible material which may be reused with said connector in said connected position.

4. The apparatus of claim 1 wherein said connector is actuated from said connected to said unconnected positions with less than a 1000 pounds tension on the wireline.

5. The apparatus of claim 1 wherein said first portion is received within said second portion to facilitate said release within the well.

6. The apparatus of claim 1 wherein said non-explosive release is actuated over a period of time whereby after said non-explosive release has been activated, said release may be deactivated before said connector moves to said unconnected position.

7. An apparatus for releasably connecting a wireline to a downhole tool, comprising:

a connector adapted for connection to the downhole tool and adapted for releasable connection to the wireline, said connector having a connected position connecting the wireline and an unconnected position releasing the wireline;

a non-explosive release disposed on said connector and maintaining said connector in the connected position, said non-explosive release adapted to be electrically connected to the wireline, said release electrically activated by the wireline to actuate said connector to said unconnected position;

said release being a material having a solid state and a fluid state, said connector being maintained in said connected position when said release material is in said solid state and said connector being released when said release material is in said fluid state.

8. The apparatus of claim 7 further including a heater changing said material from a solid state to a fluid state.

9. The apparatus of claim 8 wherein said heater is electrically connected to the wireline.

10. An apparatus for releasably connecting a wireline to a downhole tool, comprising:

a connector adapted for connection to the downhole tool and adapted for releasable connection to the wireline, said connector having a connected position connecting the wireline and an unconnected position releasing the wireline;

a non-explosive release dimposed on said connector and maintaining said connector in the connected position, said non-explosive release adapted to be electrically connected to the wireline, said release electrically activated by the wireline to actuate said connector to said unconnected position;

an anchor member attached to the wireline, said connector including at least one releasing element engaging said anchor member in said connected position.

11. The apparatus of claim 10 wherein said housing has an internal profile, said releasing element being movable between a first position and a second position with respect to said profile whereby in said first position said profile maintains said releasing element in engagement with said anchor member in said connected position and in said second position said profile allows said releasing element to move out of engagement with said anchor member in said release position.

12. The apparatus of claim 11 wherein said anchor member and said releasing element have tapered engaging surfaces in said first position for coming out of engagement in said second position.

13. The apparatus of claim 12 wherein said connector further includes a shaft with said releasing members movably mounted on said shaft, said shaft moving said releasing members from said first position to said second position.

14. The apparatus of claim 13 wherein said shaft engages said fusible material whereby said fusible material maintains said shaft and thus said releasing element in said first position.

15. The apparatus of claim 14 wherein said shaft has an enlarged portion, said enlarged portion and said fusible material being housed in a chamber within said housing.

16. The apparatus of claim 15 wherein said fusible material engages said enlarged portion to block said shaft from moving said releasing element from said first position to said second position.

17. The apparatus of claim 16 wherein said heater melts said fusible material in said chamber and allows said enlarged portion to move within said chamber whereby said shaft moves said releasing element form said first position to said second position.

18. The apparatus of claim 17 further including means for applying an upward force on said shaft to move said releasing element from said first to said second position.

19. The apparatus of claim 11 wherein said profile includes a restriction engaging said releasing element in said first position and an enlarged portion allowing said releasing element to move out of engagement with said anchor member in said second position.

20. The apparatus of claim 15 wherein said chamber is formed by an enclosure having a higher coefficient of expansion than that of said enlarged portion.

21. The apparatus of claim 20 wherein said heater includes a coil disposed around said enclosure.

22. An apparatus for releasably connecting a wireline to a downhole tool, comprising:

a housing adapted for connection to the downhole tool;

a connector disposed in said housing and having a connected position connecting said housing with the wireline and a release position releasing the wireline from said housing;

a fusible material maintaining said connector in the connected position while said material is in its solid state; and a heater for changing said fusible material to a fluid state and actuating said connector to said release position to disconnect the wireline from said housing.

23. The apparatus of claim 22 wherein said fusible material is an alloy of tin and silver.

24. The apparatus of claim 22 wherein said heater includes a coil disposed around said fusible material.

25. The apparatus of claim 24 wherein a second redundant coil is also disposed around said fusible material.

26. The apparatus of claim 22 wherein said heater is electrically connected to the wireline by circuitry disposed in said housing.

27. The apparatus of claim 26 wherein said circuitry includes switches activated by an electrical signal through the wireline for turning on said heater.

28. The apparatus of claim 27 wherein said circuitry includes redundant connections to at least two conductors in the wireline.

29. The apparatus of claim 26 wherein said circuitry includes isolators for isolating any short circuits.

30. The apparatus of claim 22 wherein said heater heats said fusible material over a length of time allowing said activation to be terminated.

31. The apparatus of claim 22 wherein said fusible material is a eutectic alloy whose solidus and liquidus temperatures are the same.

32. An apparatus for releasably connecting a wireline to a downhole tool, comprising:

connector means for connecting the downhole tool to the wireline, said connector means having a connected position connecting the wireline to the downhole tool and an unconnected position releasing the wireline from the downhole tool; and release means being non-explosive for maintaining said connector in said connected position and for actuating said connector means to said unconnected position for releasing the wireline from the downhole tool, said release means being activated electrically by the wireline and being actuated over a period of time whereby after said release means has been activated, said release means may be deactivated before said connector moves to said unconnected position.

33. A method of releasing a wireline from a downhole tool, comprising:

supporting a downhole tool in a well on a wireline having a breaking strength;

connecting the wireline to the downhole tool with a non-explosive release mechanism;

pulling on the wireline with a tension equal to one half the breaking strength without releasing the wireline;

sending an electrical signal to the non-explosive release mechanism;

actuating the release mechanism over a period of time; and optionally terminating the actuation to maintain the connection or releasing the wireline from the downhole tool.

34. The method of claim 33 further including providing a minimum tension on the wireline during the release.

35. A method of releasing a wireline from a downhole tool, comprising:

running a downhole tool into the well with a latch;

connecting electrically a heater in the downhole tool to the wireline;

turning on the heater from the wireline to heat a fusible material;

melting the fusible material allowing relative movement of said latch within said downhole tool; and releasing the wireline from the latch.

36. The method of claim 35 further comprising;

selectively retaining the downhole tool with at least one collet member; and selectively releasing said collet member by shifting a shaft within said downhole tool.

37. A wireline method for use in a wellbore and incorporating a wireline having a releasing device which includes a latch mounted on the end of a shaft, the latch releasably connectable to said wireline, a material maintaining the shaft and thus the latch in a latched position and a heater for melting said material, said method comprising:

connecting said releasing device to said downhole tool and to said wireline;

extending said wireline, with said releasing device and said downhole tool attached thereto, into the wellbore; and electrically activating the heater and heating the fusible material to allow said shaft to shift said latch to an unlatched position thereby operating the releasing device downhole.

38. An apparatus for connecting a wireline cable to a cable head comprising:

a tubular housing;

a first member having a first bore with a chamber, said chamber forming an annular shoulder;

a shaft extending into said first bore and chamber and having an enlarged diameter portion disposed within said chamber;

a fusible material disposed about said shaft in said chamber between said shoulder and said enlarged portion in a latched position;

a second member disposed within said housing and having a second bore, said second bore forming an internal profile;

said shaft extending through said second bore and having a releasable connector disposed on the end of said shaft;

said releasable connector interacting with said internal profile in said latched position connecting the wireline to the housing and in an unlatched position releasing the wireline; and a heater disposed around said fusible material melting said fusible material and allowing said shaft to move said connector to said unlatched position.

39. The apparatus of claim 38 wherein said connector includes a plurality of longitudinal, radially spreadable members mounted on the end of said shaft, said spreadable members being radially compressible in said latched position and radially spreadable in said unlatched position by said internal profile.

40. An improved apparatus for releasably connecting a wireline to a downhole tool, in which a connector is adapted for connection to the downhole tool and for releasable connection to the wireline, the connector having a connected position connecting the wireline and an unconnected position releasing the wireline, and in which a release is disposed on the connector to maintain the connector in the connected position and is adapted to be electrically connected to the wireline, the release being electrically activated by the wireline to actuate the connector to the unconnected position, wherein the improvement comprises:

the release including a material having a solid state and a fluid state, the connector being maintained in the connected position when the release material is in the solid state and being released to the unconnected position when the release material is in the fluid state.

41. An assembly comprising:

a tool string;

a wireline;

a cable head having a connector connected to the tool string and releasably connected to the wireline, said connector having a connected position connecting the wireline and an unconnected position releasing the wireline;

said connector including a material having a solid state and a fluid state, said connector being maintained in said connected position when said material is in said solid state and said connector being in said unconnected position when said material is in said fluid state; and said connector being electrically connected to said wireline to electrically activate said connector causing said material to become in said fluid state and release said wireline in said unconnected position.

42. A kit of parts for assembly into a repeatably connectable and disconnectable wireline downhole tool in a well bore, said kit of parts comprising:

a connector adapted for connection of a downhole tool to a wireline;

a downhole tool for insertion into the well bore; and a release member having a fusible material, said member capable of interfacing with said connector and said tool, wherein said connector, downhole tool and release member are capable of being assembled into said repeatably connectable and disconnectable wireline downhole tool.

43. In a kit of parts for assembly into a repeatably connectable and disconnectable wireline downhole tool, the improvement which comprises:

including a release in the kit of parts, said release fitting within a connector and between the connector and the downhole tool and being actuated over a period of time whereby after said release has been activated, said release may be deactivated before the connector disconnects the wireline.

* * * * *